US005875497A

United States Patent [19]

Lovejoy

[11] Patent Number: 5,875,497

[45] Date of Patent: Mar. 2, 1999

[54] TOILET VENTILATION SYSTEM

[76] Inventor: Curtis Lovejoy, 230 Nutmeg Dr., Torrington, Conn. 06790

[21] Appl. No.: 1,432

[22] Filed: Dec. 31, 1997

[51] Int. Cl.[6] ..... E03D 9/04

[52] U.S. Cl. ..... 4/213

[58] Field of Search ..... 4/213, 216, 217, 4/352

[56] References Cited

U.S. PATENT DOCUMENTS

| | | | |
|---|---|---|---|
| 2,172,506 | 9/1939 | Gerger | 4/217 |
| 3,751,824 | 8/1973 | Poister | 4/213 |
| 4,175,293 | 11/1979 | Stephens et al. | 4/213 X |
| 4,402,091 | 9/1983 | Ellis et al. | 4/217 |
| 4,433,441 | 2/1984 | Schroeder | 4/213 |
| 4,944,045 | 7/1990 | Agelatos et al. | 4/213 |

*Primary Examiner*—Charles E. Phillips

[57] ABSTRACT

A bathroom deodorizer is included with a plenum having an annular configuration. The plenum includes a planar circular bottom face, a planar circular top face and a thin inner and outer periphery formed therebetween to define an interior space and a size and shape similar to that of a toilet seat. The inner periphery of the plenum has a plurality of breathing apertures formed therein. A vacuum assembly is connected to the plenum for suctioning air from the breathing apertures and expelling the same upon the actuation thereof.

1 Claim, 2 Drawing Sheets

FIG. 1
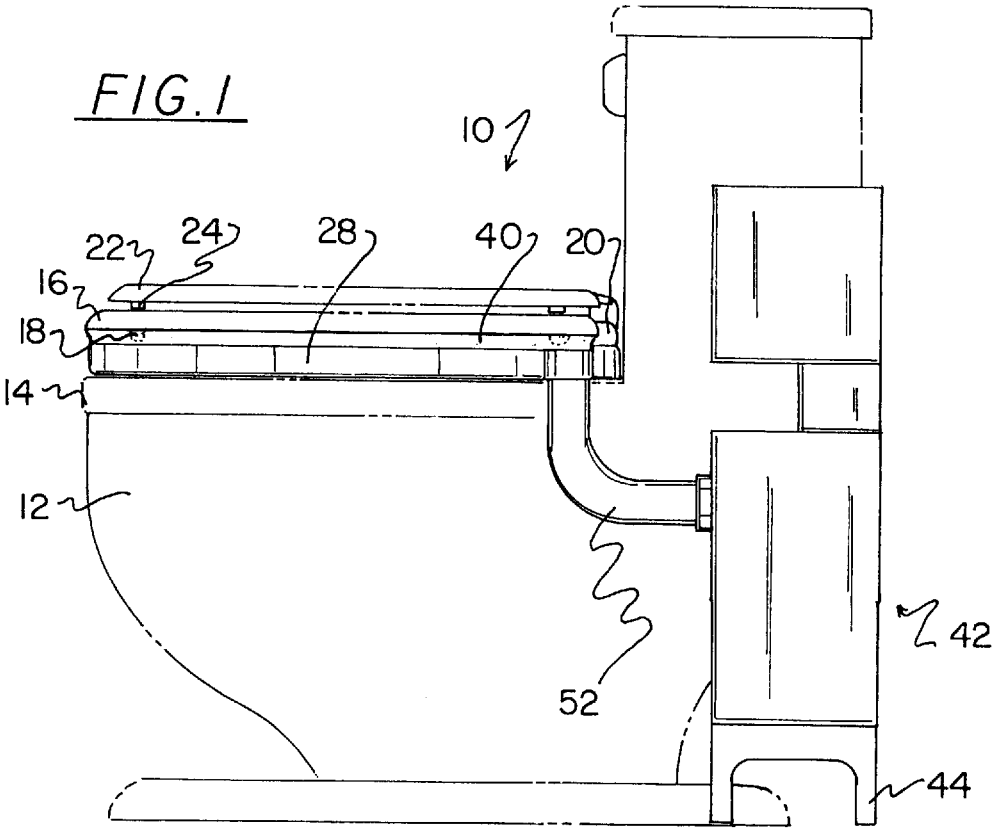
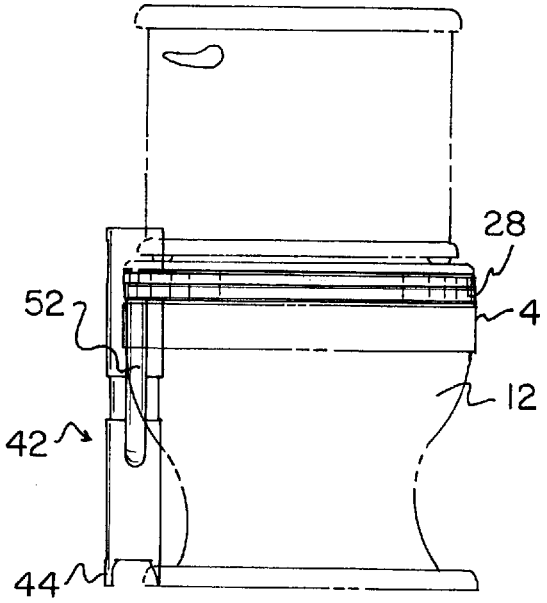
FIG. 2

TOILET VENTILATION SYSTEM

BACKGROUND OF THE INVENTION

1. Field of the Invention

The present invention relates to toilet vents and more particularly pertains to a new toilet ventilation system for providing a seal between an upper peripheral edge of a toilet bowl and an associated seat with a plenum having breathing apertures which suction air from the toilet bowl.

2. Description of the Prior Art

The use of toilet vents is known in the prior art. More specifically, toilet vents heretofore devised and utilized are known to consist basically of familiar, expected and obvious structural configurations, notwithstanding the myriad of designs encompassed by the crowded prior art which have been developed for the fulfillment of countless objectives and requirements.

Known prior art toilet vents include U.S. Pat. No. 5,161,262; U.S. Pat. No. 5,452,481; U.S. Pat. No. Des. 326,510; U.S. Pat. No. 5,452,481; U.S. Pat. No. Des. 326,510; U.S. Pat. No. 5,345,617; U.S. Pat. No. 5,054,130; and U.S. Pat. No. 4,876,748.

In these respects, the toilet ventilation system according to the present invention substantially departs from the conventional concepts and designs of the prior art, and in so doing provides an apparatus primarily developed for the purpose of providing a seal between an upper peripheral edge of a toilet bowl and an associated seat with a plenum having breathing apertures which suction air from the toilet bowl.

SUMMARY OF THE INVENTION

In view of the foregoing disadvantages inherent in the known types of toilet vents now present in the prior art, the present invention provides a new toilet ventilation system construction wherein the same can be utilized for providing a seal between an upper peripheral edge of a toilet bowl and an associated seat with a plenum having breathing apertures which suction air from the toilet bowl.

The general purpose of the present invention, which will be described subsequently in greater detail, is to provide a new toilet ventilation system apparatus and method which has many of the advantages of the toilet vents mentioned heretofore and many novel features that result in a new toilet ventilation system which is not anticipated, rendered obvious, suggested, or even implied by any of the prior art toilet vents, either alone or in any combination thereof.

To attain this, the present invention generally comprises a toilet bowl having a planar upper peripheral edge with a circular configuration including a pair of bores formed in a rear extent thereof. A seat is provided with an annular configuration having a plurality of posts coupled to a bottom surface thereof which extend downwardly therefrom. The seat is hingably coupled to a rectangular mount at a rear extent thereof. A closed planar lid is provided having a plurality of posts coupled to a bottom surface thereof and extending downwardly therefrom. Similar to the seat, the lid is hingably coupled to the rectangular mount at a rear extent thereof such that the lid may be pivoted between a raised and lowered orientation with the posts resting on the seat. The rectangular mount has a pair of spaced bolts depending downwardly therefrom for being received and coupled within the bores of the toilet bowl. Next provided is an elastomeric plenum having an annular configuration including a planar circular bottom face, a planar circular top face and a thin inner and outer periphery formed therebetween to define an interior space and a size and shape similar to that of the seat. As shown in FIG. 3, the inner periphery has a plurality of equally spaced breathing apertures formed therein along an entire circumference thereof. The plenum has a pair of spaced vertically aligned mounting apertures formed in the top and bottom face thereof with a coupling tube formed therebetween. Such coupling tube functions to preclude communication between the mounting apertures and the interior space of the plenum. With reference still to FIG. 3, it can be shown that the plenum has a pair of ears extending outwardly therefrom. A bottom face of one of the ears has a coupling bore formed therein for reasons that will become apparent hereinafter. During use, the plenum may be situated on the upper peripheral edge of the toilet bowl in concentric relationship therewith. Further, the bolts of the toilet bowl extend through the mounting apertures of the plenum thereby allowing the placement of the lid and seat of the toilet bowl above the plenum. Mounted on the top face of the plenum is a thin gasket having a shape similar to the top face of the plenum. A top surface of the thin gasket includes a plurality of recesses for removably receiving the posts of the seat when in the lowered orientation. As such, the bottom surface of the seat rests on the top face of the gasket for sealing purposes. Also included is a vacuum assembly with a rectangular housing resting on a recipient surface to a side of the toilet bowl via a plurality of legs. The housing of the vacuum assembly further includes an inlet opening formed in a front face thereof and an outlet opening formed in a top face thereof. A motorized vacuum is mounted within the housing between the inlet opening and the outlet opening for suctioning air from the inlet opening and excreting the same from the outlet opening upon the actuation thereof. For providing communication between the vacuum assembly and the plenum, an elbow pipe is provided. The elbow has an end of a vertical extent thereof coupled to the coupling bore of the plenum. Further an end of a horizontal extent of the elbow is coupled to the inlet opening of the vacuum assembly. FIG. 4 shows a scented air freshener with a rectangular configuration having an input mounted on a lower face thereof for communicating with the outlet opening of the vacuum assembly. Associated therewith is an output formed on a top face thereof. A scented filter is mounted horizontally between the input and output for scenting air which is suctioned from the breathing apertures of the plenum.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toilet ventilation system apparatus and method which has many of the advantages of the toilet vents mentioned heretofore and many novel features that result in a new toilet ventilation system which is not anticipated, rendered obvious, suggested, or even implied by any of the prior art toilet vents, either alone or in any combination thereof.

It is another object of the present invention to provide a new toilet ventilation system which may be easily and efficiently manufactured and marketed.

It is a further object of the present invention to provide a new toilet ventilation system which is of a durable and reliable construction.

An even further object of the present invention is to provide a new toilet ventilation system which is susceptible of a low cost of manufacture with regard to both materials and labor, and which accordingly is then susceptible of low prices of sale to the consuming public, thereby making such toilet ventilation system economically available to the buying public.

Still yet another object of the present invention is to provide a new toilet ventilation system which provides in the apparatuses and methods of the prior art some of the advantages thereof, while simultaneously overcoming some of the disadvantages normally associated therewith.

Still another object of the present invention is to provide a new toilet ventilation system for providing a seal between an upper peripheral edge of a toilet bowl and an associated seat with a plenum having breathing apertures which suction air from the toilet bowl.

Even still another object of the present invention is to provide a new toilet ventilation system that includes a plenum having an annular configuration. The plenum includes a planar circular bottom face, a planar circular top face and a thin inner and outer periphery formed therebetween to define an interior space and a size and shape similar to that of a toilet seat. The inner periphery of the plenum has a plurality of breathing apertures formed therein. A vacuum assembly is connected to the plenum for suctioning air from the breathing apertures and expelling the same upon the actuation thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side view of a new toilet ventilation system according to the present invention.

FIG. 2 is a front view of the present invention.

DESCRIPTION OF THE PREFERRED EMBODIMENT

Figure 3:
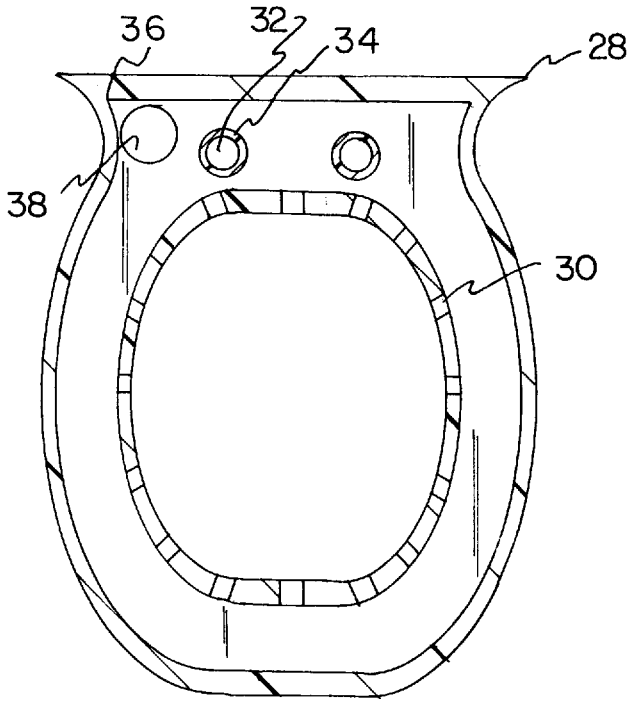
FIG. 3 is a cross-sectional view of the plenum of the present invention.

With reference now to the drawings, and in particular to FIGS. 1 through 4 thereof, a new toilet ventilation system embodying the principles and concepts of the present invention and generally designated by the reference numeral 10 will be described.

The present invention, as designated as numeral 10, includes a toilet bowl 12 having a planar upper peripheral edge 14 with a circular configuration including a pair of bores formed in a rear extent thereof. A seat 16 is provided with an annular configuration having a plurality of posts 18 coupled to a bottom surface thereof which extend downwardly therefrom. The seat is hingably coupled to a rectangular mount 20 at a rear extent thereof. A closed planar lid 22 is provided having a plurality of posts 24 coupled to a bottom surface thereof and extending downwardly therefrom. Similar to the seat, the lid is hingably coupled to the rectangular mount at a rear extent thereof such that the lid may be pivoted between a raised and lowered orientation with the posts resting on the seat. The rectangular mount has a pair of unillustrated spaced bolts depending downwardly therefrom for being received and coupled within the bores of the toilet bowl.

Next provided is an elastomeric plenum 28 having an annular configuration including a planar circular bottom face, a planar circular top face and a thin inner and outer periphery formed therebetween with a constant height to define an interior space and a size and shape similar to that of the seat. As shown in FIG. 3, the inner periphery has a plurality of equally spaced breathing apertures 30 formed therein along an entire circumference thereof.

The plenum has a pair of spaced vertically aligned mounting apertures 32 formed in the top and bottom face thereof with a coupling tube 34 formed therebetween. Such coupling tube functions to preclude communication between the mounting apertures and the interior space of the plenum. With reference still to FIG. 3, it can be shown that the plenum has a pair of ears 36 extending outwardly therefrom at the rear extent thereof. A bottom face of one of the ears has a coupling bore 38 formed therein for reasons that will become apparent hereinafter.

During use, the plenum may be situated on the upper peripheral edge of the toilet bowl in concentric relationship therewith. Ideally, the plenum is equipped with a linear rear edge for residing in abutment with the toilet water reservoir. Further, the bolts of the toilet bowl extend through the mounting apertures of the plenum thereby allowing the placement of the lid and seat of the toilet bowl above the plenum via nuts or the like.

Mounted on the top face of the plenum is a thin elastomeric gasket 40 having a shape similar to the top face of the plenum. A top surface of the thin gasket includes a plurality of recesses for removably receiving the posts of the seat when in the lowered orientation. As such, the bottom surface of the seat rests on the top face of the gasket for sealing purposes.

Also included is a vacuum assembly 42 with a rectangular housing resting on a recipient surface to a side of the toilet bowl via a plurality of legs 44. The housing of the vacuum assembly further includes an inlet opening 46 formed in a front face thereof and an outlet opening 48 formed in a top face thereof. A motorized vacuum 50 is mounted within the housing between the inlet opening and the outlet opening for suctioning air from the inlet opening and expelling the same from the outlet opening upon the actuation thereof. It should be noted that the actuation of the vacuum assembly may be effected by way of a weight switch or the like.

For providing communication between the vacuum assembly and the plenum, an elbow pipe 52 is provided. The elbow has an end of a vertical extent thereof coupled to the coupling bore of the plenum. Further an end of a horizontal extent of the elbow is coupled to the inlet opening of the vacuum assembly.

Figure 4:
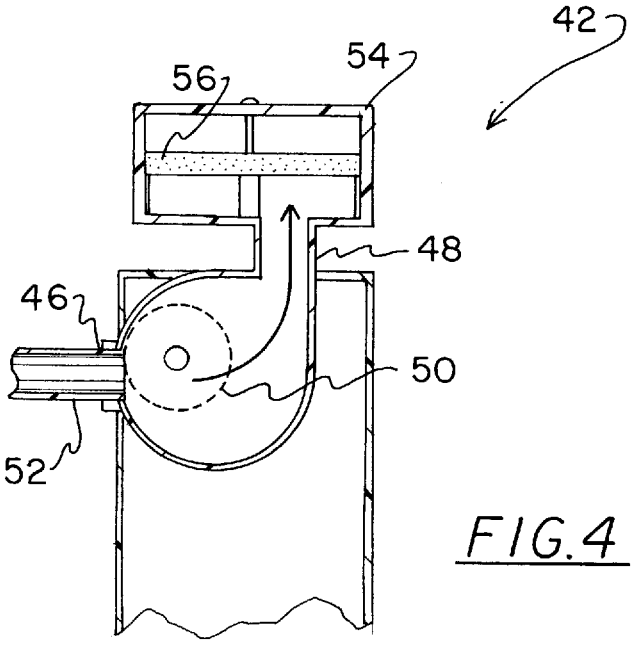
FIG. 4 is a cross-sectional view of the vacuum assembly and air freshener of the present invention.

FIG. 4 shows a scented air freshener 54 with a rectangular configuration having an input mounted on a lower face thereof for communicating with the outlet opening of the vacuum assembly. Associated therewith is an output formed on a top face thereof. A scented filter 56 is mounted horizontally between the input and output for scenting air which is suctioned from the breathing apertures of the plenum. As an option, the air freshener may be adapted to excrete the air to a distant location. Further, a top of the air freshener may be removable by way of a screw for allowing the replacement of the filter. As yet a further option, a purifying chamber may be employed in addition to the scented air freshener. Such chamber would precede the scented air freshener to remove methane gas. In such embodiment, a scented air freshener would be an option.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bathroom deodorizer comprising, in combination:

a toilet bowl having a planar upper peripheral edge with a circular configuration and a pair of bores formed in a rear extent thereof, a seat with an annular configuration having a plurality of posts coupled to a bottom surface thereof and extending downwardly therefrom wherein the seat is hingably coupled to a substantially rectangular mount at a rear extent thereof, a closed planar lid having a plurality of posts coupled to a bottom surface thereof and extending downwardly therefrom wherein the lid is hingably coupled to the rectangular mount at a rear extent thereof such that the lid may be pivoted between a raised and lowered orientation with the posts resting on the seat, whereby the rectangular mount has a pair of spaced bolts depending downwardly therefrom being received and coupled within the bores of the toilet bowl;

an elastomeric plenum having an annular configuration including a planar circular bottom face, a planar circular top face and a thin inner and outer periphery formed therebetween to define an interior space and a size and shape similar to that of the seat, the inner periphery having a plurality of equally spaced breathing apertures formed therein along an entire circumference thereof, the plenum having a pair of spaced vertically aligned mounting apertures formed in the top and bottom face thereof with a coupling tube formed therebetween and spaced from the outer periphery to preclude communication between the mounting apertures and the interior space of the plenum, the plenum having a pair of ears extending outwardly therefrom adjacent to a linear rear edge of the plenum with a bottom face of one of the ears having a coupling bore formed therein, whereby the plenum may be situated on the upper peripheral edge of the toilet bowl in concentric relationship therewith and the bolts of the toilet bowl extending through the mounting apertures of the plenum thereby allowing the placement of the lid and seat of the toilet bowl above the plenum;

a thin gasket mounted on the top face of the plenum and having a shape similar to the top face of the plenum, a top surface of the thin gasket including a plurality of recesses for removably receiving the posts of the seat when in the lowered orientation such that the bottom surface of the seat rests on the top face of the gasket for sealing purposes;

a vacuum assembly including a substantially rectangular housing resting on a recipient surface to a side of the toilet bowl via a plurality of legs, the vacuum assembly being supportable by the legs in a free standing relationship with respect to the toilet bowl to permit positioning away from the toilet bowl, the housing of the vacuum assembly further including an inlet opening formed in a front face thereof, an outlet opening formed in a top face thereof, and a switch-actuated motorized vacuum mounted within the housing between the inlet opening and the outlet opening for suctioning air from the inlet opening and excreting the same from the outlet opening upon the actuation thereof;

an elbow pipe having an end of a vertical extent thereof coupled to the coupling bore of the plenum and an end of a horizontal extent thereof coupled to the inlet opening of the vacuum assembly for affording communication therebetween; and a scented air freshener chamber with a substantially rectangular configuration, the air freshener chamber being positioned above the vacuum assembly and supported on the vacuum assembly the air freshener chamber having an input tube mounted on a lower face thereof for communicating with the outlet opening of the vacuum assembly and a output formed on a top face of the air freshener chamber and with a scented filter mounted horizontally between the input tube and output for scenting air which is suctioned from the breathing apertures of the plenum of the chamber and expelled from said chamber.

* * * * *